US011316281B2

(12) United States Patent
Han et al.

(10) Patent No.: US 11,316,281 B2
(45) Date of Patent: Apr. 26, 2022

(54) ANTENNA APPARATUS

(71) Applicants: SAMSUNG ELECTRO-MECHANICS CO., LTD., Suwon-si (KR); Research & Business Foundation Sungkyunkwan University, Suwon-si (KR)

(72) Inventors: Myeong Woo Han, Suwon-si (KR); Dae Ki Lim, Suwon-si (KR); Keum Cheol Hwang, Seoul (KR); Sung Woo Lee, Suwon-si (KR); Jeong Ki Ryoo, Suwon-si (KR)

(73) Assignees: Samsung Electro-Mechanics Co., Ltd., Suwon-si (KR); Research & Business Foundation Sungkyunkwan University, Suwon-si (KR)

( * ) Notice: Subject to any disclaimer, the term of this patent is extended or adjusted under 35 U.S.C. 154(b) by 174 days.

(21) Appl. No.: 16/662,508

(22) Filed: Oct. 24, 2019

(65) Prior Publication Data

US 2021/0005982 A1 Jan. 7, 2021

(30) Foreign Application Priority Data

Jul. 3, 2019 (KR) ..... 10-2019-0079869

(51) Int. Cl.
*H01Q 21/06* (2006.01)
*H01Q 1/24* (2006.01)

(52) U.S. Cl.
CPC ..... *H01Q 21/065* (2013.01); *H01Q 1/241* (2013.01)

(58) Field of Classification Search
CPC ..... H01Q 1/22; H01Q 1/2283; H01Q 1/241; H01Q 1/243; H01Q 5/385; H01Q 21/06; H01Q 21/065; H01Q 19/00; H01Q 19/005; H01Q 9/04; H01Q 9/0414; H01Q 9/045
See application file for complete search history.

(56) References Cited

U.S. PATENT DOCUMENTS

| | | | | |
|---|---|---|---|---|
| 8,405,552 | B2 * | 3/2013 | Bae | H01Q 15/0093 343/700 MS |
| 9,620,861 | B1 * | 4/2017 | Banks | H01Q 9/0407 |
| 2013/0003333 | A1 * | 1/2013 | Toyao | H05K 1/0298 361/777 |
| 2017/0310017 | A1 * | 10/2017 | Howard | H01Q 21/0006 |
| 2019/0229398 | A1 * | 7/2019 | Ryoo | H01L 23/66 |
| 2020/0028269 | A1 * | 1/2020 | Kim | H01Q 19/108 |
| 2020/0395680 | A1 * | 12/2020 | Kim | H01Q 5/385 |

FOREIGN PATENT DOCUMENTS

| | | | |
|---|---|---|---|
| JP | 5891359 | B2 | 3/2016 |
| KR | 10-2009-0110175 | A | 10/2009 |

* cited by examiner

*Primary Examiner* — Thai Pham
(74) *Attorney, Agent, or Firm* — NSIP Law

(57) ABSTRACT

An antenna apparatus may include: a feed via; a patch antenna pattern electrically connected to the feed via; and coupling patterns spaced apart from the patch antenna pattern and spaced apart from each other. At least one of the coupling patterns may protrude in a direction in which the at least one of the coupling patterns is spaced apart from the patch antenna pattern.

18 Claims, 16 Drawing Sheets

ANTENNA APPARATUS

CROSS-REFERENCE TO RELATED APPLICATIONS

This application claims the benefit under 35 U.S.C. § 119(a) of Korean Patent Application No. 10-2019-0079869 filed on Jul. 3, 2019 in the Korean Intellectual Property Office, the entire disclosure of which is incorporated herein by reference for all purposes.

BACKGROUND

1. Field

The following description relates to an antenna apparatus.

2. Description of Related Art

Mobile communications data traffic has increased on an annual basis. Various techniques have been developed to support the rapid increase in data in wireless networks in real time. For example, conversion of Internet of Things (IoT)-based data into contents, augmented reality (AR), virtual reality (VR), live VR/AR linked with SNS, an automatic driving function, applications such as a sync view (transmission of real-time images at a user viewpoint using a compact camera), and the like, may require communications (e.g., 5G communications, mmWave communications, and the like) that support the transmission and reception of large volumes of data.

Accordingly, there has been research on mmWave communications including 5th generation (5G), and research into the commercialization and standardization of an antenna apparatus for implementing such communications has been conducted.

An RF signal of a high frequency band (e.g., 24 GHz, 28 GHz, 36 GHz, 39 GHz, 60 GHz, and the like) may easily be absorbed and lost during transmission, which may degrade quality of communications. Thus, an antenna for communications performed in a high frequency band may require a technical approach that is different from techniques used in a general antenna, and a special technique such as implementing a separate power amplifier, and the like, may be required to secure antenna gain, integration of an antenna and an RFIC, effective isotropic radiated power (EIRP), and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes: a feed via; a patch antenna pattern electrically connected to the feed via; and coupling patterns spaced apart from the patch antenna pattern and spaced apart from each other. At least one of the coupling patterns protrudes in a direction in which the at least one of the coupling patterns is spaced apart from the patch antenna pattern.

The at least one of the coupling patterns may include protruding portions protruding at different locations.

A width of a gap between adjacent protruding portions among the protruding portions may be less than a width of each of the protruding portions.

A coupling pattern, among the coupling patterns, spaced apart from the patch antenna pattern in a second direction may have an area greater than an area of a coupling pattern, among the coupling patterns, spaced apart from the patch antenna pattern in a first direction different from the second direction.

The patch antenna pattern may include patch antenna patterns. The patch antenna patterns may be arranged in a row in the second direction.

A coupling pattern, among the coupling patterns, may be spaced apart from the patch antenna pattern in the second direction, and may include a first portion protruding in the second direction and a second portion protruding towards the patch antenna pattern. The second portion may protrude towards the patch antenna portion by a length shorter than a length by which the first portion protrudes in the second direction.

Each of the coupling patterns may protrude in a direction in which the each of the coupling patterns is spaced apart from the patch antenna pattern. A coupling pattern among the each of the coupling patterns may be spaced apart from the patch antenna pattern in the second direction and may include portions protruding towards the patch antenna pattern. A coupling pattern among the each of the coupling patterns may be spaced apart from the patch antenna pattern in a first direction different from the second direction and may not include portions protruding towards the patch antenna pattern.

The antenna apparatus may further include: a ground plane having a through-hole through which the feed via penetrates. A conductive structure may not be connected between the coupling patterns and the ground plane.

The antenna apparatus may further include: a coupling patch pattern disposed above the patch antenna pattern and spaced apart from the patch antenna pattern. The coupling patterns may be arranged to surround the coupling patch pattern.

In a region including pixels each having an area smaller than an area of a smallest coupling pattern among the coupling patterns, each of the coupling patterns may be disposed to occupy portions of the pixels and to not occupy other portions of the pixels.

The coupling patterns may include a first coupling pattern spaced apart from the patch antenna pattern in a first direction, a second coupling pattern spaced apart from the patch antenna pattern in a second direction, and a corner coupling pattern disposed between the first coupling pattern and the second coupling pattern.

Each of the coupling patterns may include three or more protruding portions.

In another general aspect, an antenna apparatus includes: a feed via; a patch antenna pattern electrically connected to the feed via; and coupling patterns spaced apart from the patch antenna pattern and spaced apart from each other. In a region including pixels each having an area smaller than an area of a smallest coupling pattern among the coupling patterns, each of the coupling patterns occupies some pixels, among the pixels, and includes five or more vertices.

A width of the some pixels occupied by the coupling patterns is greater than a width of other pixels, among the pixels, that are not occupied by the coupling patterns.

The antenna apparatus may further include: a coupling patch pattern disposed above the patch antenna pattern and spaced apart from the patch antenna pattern. The coupling patch pattern and the coupling patterns may be disposed on a same level.

A region disposed on a level of the patch antenna pattern and overlapping the coupling patch pattern may be formed of a non-conductive medium.

The patch antenna pattern may include patch antenna patterns. The patch antenna patterns may be arranged in a row in one direction.

A coupling pattern, among the coupling patterns, spaced apart from the patch antenna pattern in the one direction may have an area greater than an area of a coupling pattern, among the coupling patterns, spaced apart from the patch antenna pattern in another direction different from the one direction.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
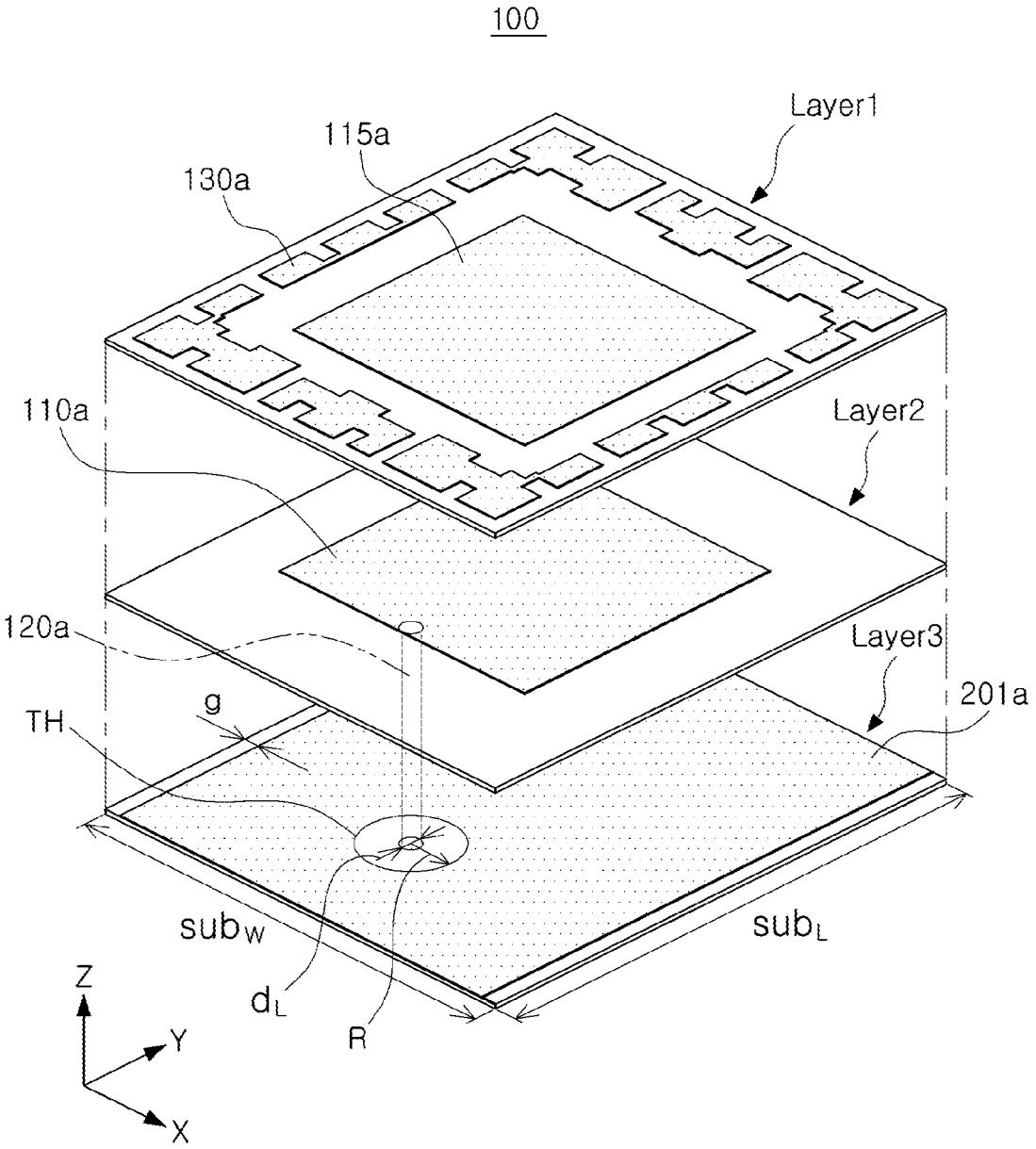
FIG. 1A is a perspective view illustrating an antenna apparatus, according to an embodiment.

According to an aspect of the following disclosure, an antenna apparatus that may improve antenna performance (e.g., a gain, a bandwidth, directivity, etc.) and/or may be easily miniaturized is described.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Figure 1B:
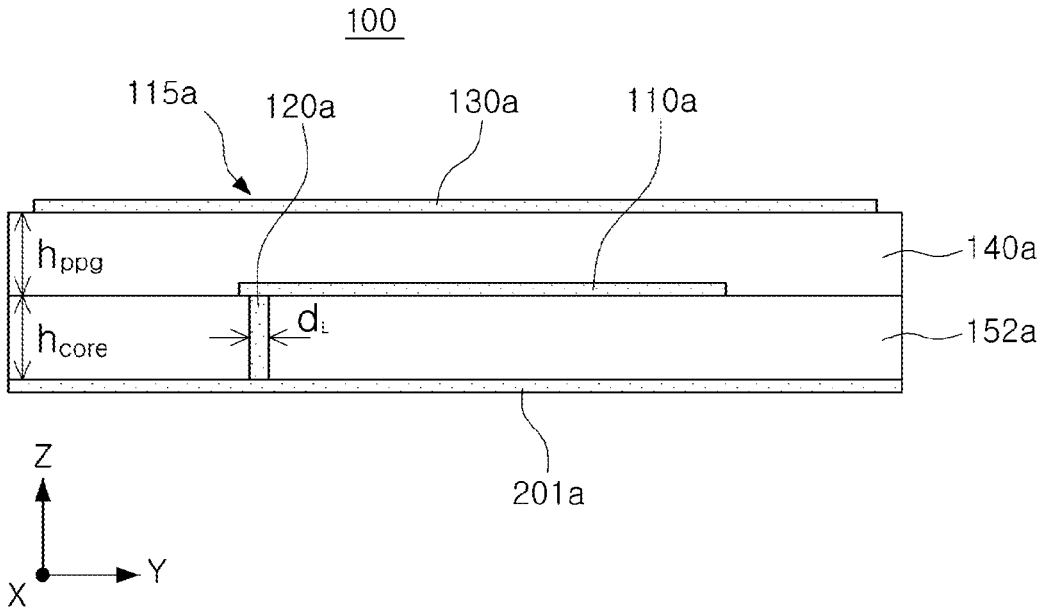
FIG. 1B is a side view illustrating the antenna apparatus of FIG. 1A, according to an embodiment.
Figure 1C:
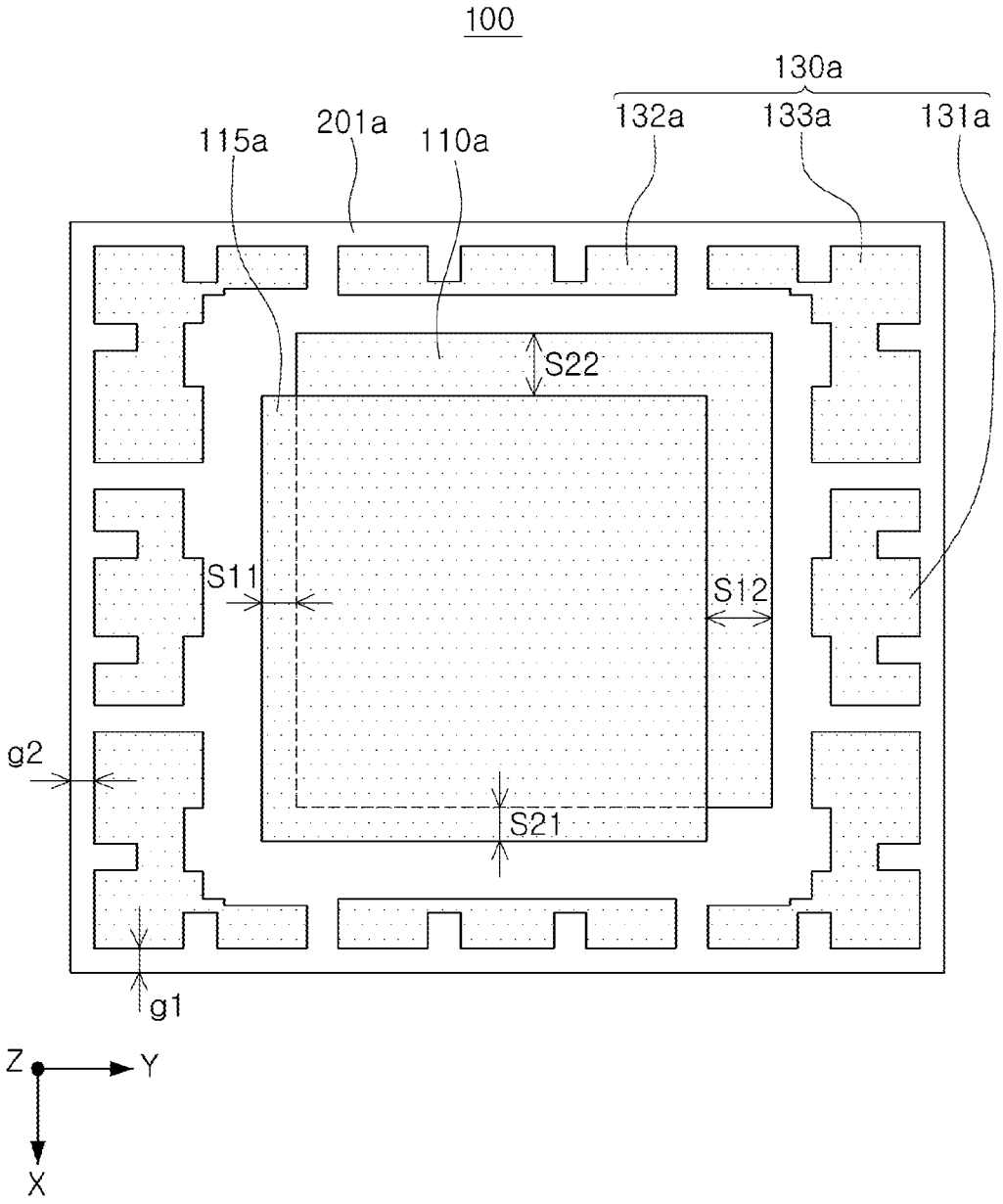
FIG. 1C is a plan view illustrating the antenna apparatus of FIG. 1A, according to an embodiment.

FIG. 1A is a perspective view illustrating an antenna apparatus 100, according to an embodiment. FIG. 1B is a side view illustrating the antenna apparatus 100. FIG. 1C is a plan view illustrating the antenna apparatus 100.

Referring to FIGS. 1A, 1B, and 1C, the antenna apparatus 100 may include a patch antenna pattern 110*a*, a feed via 120*a*, and coupling patterns 130*a*. The coupling patterns 130*a* may include a first coupling pattern 132a, a second coupling pattern 131*a*, and a corner coupling pattern 133*a*.

The feed via 120*a* may provide an electrical connection path between an integrated circuit (IC) and the patch antenna pattern 110*a*, and may function as a transmission line of a radio frequency (RF) signal.

The patch antenna pattern 110*a* may receive an RF signal from the feed via 120*a* and may remotely transmit the RF signal in a Z direction, or may transfer a remotely received RF signal to the feed via 120*a*.

An upper surface of the patch antenna pattern 110*a* may be a space on which a surface current flows, and the surface current may be irradiated into the air in a normal direction of the upper surface of the patch antenna pattern 110*a* in accordance with resonance of the patch antenna pattern 110*a*.

The patch antenna pattern 110*a* may have a bandwidth based on an intrinsic resonance frequency determined by a configuration of intrinsic elements (e.g., a form, a size, a thickness, a spacing distance, a dielectric constant of an insulating layer, and the like) and an extrinsic resonance frequency determined by an electromagnetic coupling with an adjacent antenna pattern and/or a via.

The coupling patterns 130*a* may be spaced apart from the patch antenna pattern 110*a* and may be spaced apart from each other. The coupling patterns 130*a* may be electromagnetically coupled to the patch antenna pattern 110*a*, and may provide impedance to the patch antenna pattern 110*a*. The impedance may affect a resonance frequency of the patch antenna pattern 110*a*, and accordingly, the patch antenna pattern 110*a* may increase a gain or may widen a bandwidth in accordance with an electromagnetic coupling between the coupling patterns 130*a*.

A surface current flowing on the patch antenna pattern 110*a* may flow from one edge of the patch antenna pattern 110*a* to another edge of the patch antenna pattern 110*a*. As the coupling patterns 130*a* are electromagnetically coupled to the patch antenna pattern 110*a*, the coupling patterns 130*a* may provide an additional area on which the surface current flows.

Viewed in the Z direction, each of the coupling patterns 130*a* may protrude in a direction in which the coupling pattern 130*a* is spaced apart from the patch antenna pattern 110*a*.

An overall radiation pattern formed by a surface current flowing on the patch antenna pattern 110*a* may be formed in the Z direction, and a portion of the radiation pattern may be formed in a direction different from the Z direction. The foregoing characteristics of the radiation pattern may be due to an electromagnetic boundary condition at a center of the patch antenna pattern 110*a* being slightly different from an electromagnetic boundary condition on an edge of the patch antenna pattern 110*a*. A portion of the radiation pattern may be defined as a side lobe.

When each of the coupling patterns 130*a* is configured to protrude in a direction in which the coupling pattern 130*a* is spaced apart from the patch antenna pattern 110*a*, a form of each of the plurality of coupling patterns 130*a* may reduce a deviation of an electromagnetic boundary condition of the patch antenna pattern 110*a*. Accordingly, a side lobe of the patch antenna pattern 110*a* may decrease, the radiation pattern of the patch antenna pattern 110*a* may be more focused in the Z direction, and a gain of the patch antenna pattern 110*a* may improve.

Also, by each of the plurality of coupling patterns 130*a* protruding in a direction in which the coupling pattern 130*a* is spaced apart from the patch antenna pattern 110*a*, a surface current flowing on the coupling patterns 130*a* may be more dispersed than a surface current flowing on the patch antenna pattern 110*a*. An electric field and a magnetic field corresponding to a radiated RF signal may be dependent on a direction of a surface current corresponding to the RF signal, and may cause electromagnetic interference with an adjacent antenna. As a surface current flowing on the coupling patterns 130*a* closer to an adjacent antenna is more dispersed, electromagnetic interference with the adjacent antenna caused by the surface current may decrease.

Thus, electromagnetic interference between the patch antenna patterns 110*a* may decrease in a structure in which the patch antenna patterns 110*a* are arranged in a row in a single direction, and an overall gain of the plurality of patch antenna patterns 110*a* may improve.

For example, the coupling patterns 130*a* may have protruding portions at three or more different locations. Accordingly, a form of the coupling patterns 130*a* may be similar to a fractal structure. The fractal structure may significantly reduce an electromagnetic bottleneck phenomenon occurring around the coupling patterns 130*a*. Thus, the coupling patterns 130*a* having a structure similar to the fractal structure may further increase electromagnetic efficiency of the patch antenna pattern 110*a*, and accordingly, a gain and/or a bandwidth of the patch antenna pattern 110*a* may improve.

The antenna apparatus 100 may further include a coupling patch pattern 115*a* disposed above the patch antenna pattern 110*a* and spaced apart from the patch antenna pattern 110*a*.

The coupling patch pattern 115*a* may be electromagnetically coupled to the patch antenna pattern 110*a*, and may thus provide additional impedance. Accordingly, the patch antenna pattern 110*a* may have a broader bandwidth.

The coupling patterns 130*a* may be configured to surround the coupling patch pattern 115*a*. Accordingly, the coupling patterns 130*a* may electromagnetically relay the coupling patch pattern 115*a* and the patch antenna pattern 110*a*, and may improve a gain and/or a bandwidth of the patch antenna pattern 110*a*.

For example, the coupling patch pattern 115*a* and the coupling patterns 130*a* may be disposed on a first layer Layer1, and the patch antenna pattern 110*a* may be disposed on a second layer Layer2.

The antenna apparatus 100 may further include a ground plane 201*a* disposed on a third layer Layer3.

The ground plane 201*a* may have a through-hole TH through which the feed via 120*a* penetrates. A width R of the through-hole TH may be greater than a width $d_L$ of the feed via 120*a*.

The ground plane 201*a* may have a length $sub_W$ taken in the first direction and a length $sub_L$ taken in the second direction, and may have a margin having a margin length g.

A dielectric layer 140*a* may occupy a region corresponding to a thickness $h_{ppg}$ of the dielectric layer disposed between the first layer Layer1 and the second layer Layer2, and a core region 152*a* may occupy a region corresponding to a thickness $h_{core}$ of a core region between the second layer Layer2 and the third layer Layer3.

Figure 1D:
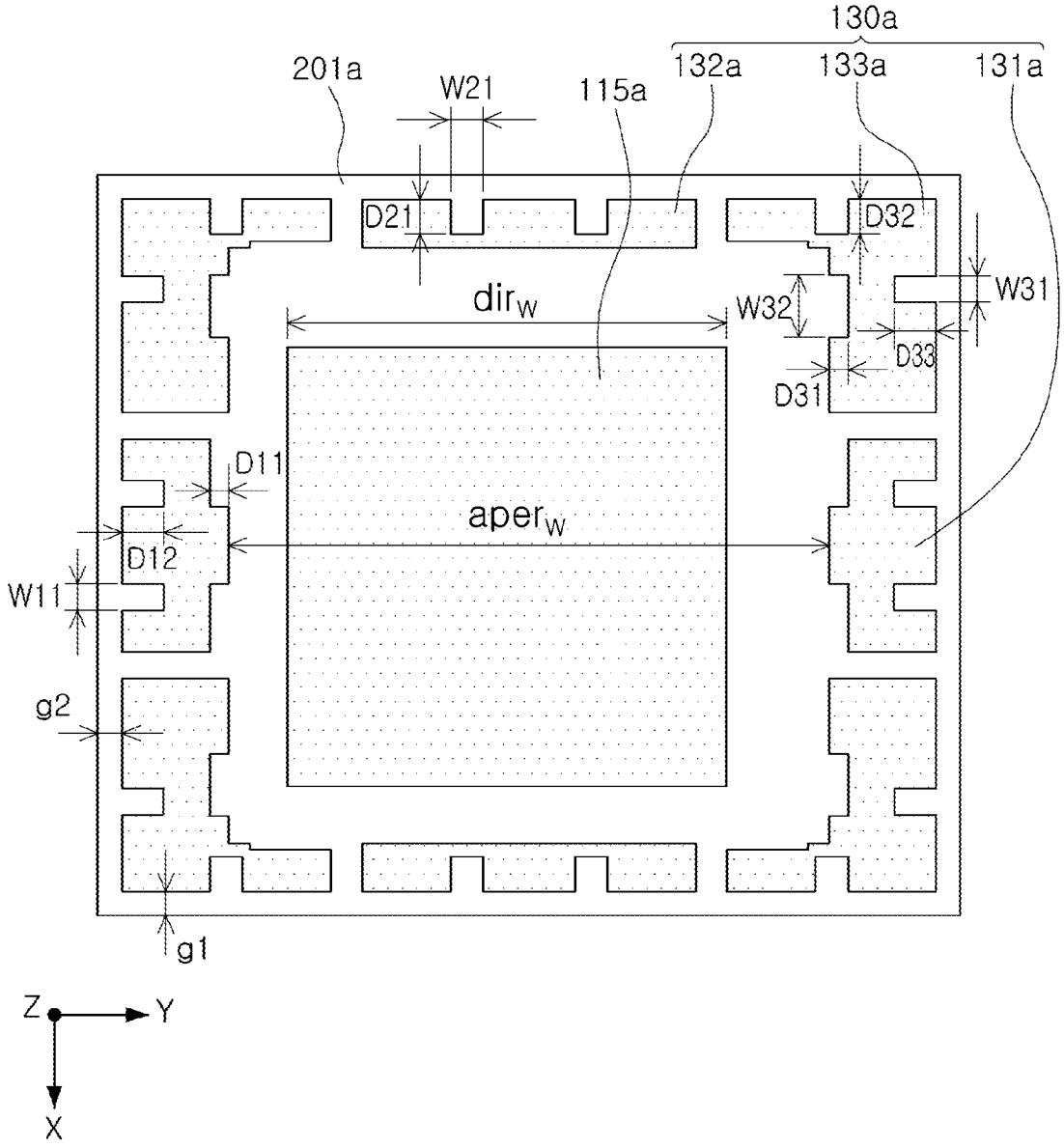
FIG. 1D is a plan view illustrating dimensions of coupling patterns of the antenna apparatus of FIG. 1A, according to an embodiment.

As shown in FIG. 1D, the patch antenna pattern 110*a* and the coupling patch pattern 115*a* may form a non-overlapping area corresponding to a first gap S11, a second gap S12, a third gap S21, and a fourth gap S22. A size (e.g., an area) of the non-overlapping area may function as a factor for optimizing a bandwidth of the patch antenna pattern 110*a*.

The coupling patterns 130*a* may have a margin corresponding to a first gap and a second gap g1 and g2, as shown in FIG. 1D. Accordingly, the coupling patterns 130*a* may be spaced apart from a coupling pattern corresponding to an adjacent coupling patch pattern, and electromagnetic interference between the coupling patterns 130*a* and the adjacent coupling patch pattern may decrease.

FIG. 1D is a plan view illustrating dimensions of the coupling patterns 130*a* of the antenna apparatus 100, according to an embodiment.

Referring to FIG. 1D, each of gaps W11, W31, and W32 between protruding portions of each of the coupling patterns 130*a* may be less than a width of each of the protruding portions of each of the coupling patterns 130*a*.

Accordingly, the coupling patterns 130*a* may have a structure in which a surface current may flow in a dispersed manner, and loss caused by an increase in resistance may be reduced.

Lengths D12 and D33 of protruding portions of a coupling pattern among the coupling patterns 130*a* spaced apart from the patch antenna pattern 110*a* in a second direction (e.g., a Y direction) may be the same as lengths D21 and D32 of protruding portions of coupling patterns 130*a* spaced apart from the patch antenna pattern 110*a* in a first direction (e.g., an X direction).

The coupling pattern among the coupling patterns 130*a* spaced apart from the patch antenna pattern 110*a* in the second direction (e.g., the Y direction) may further include protruding portions protruding towards the patch antenna pattern 110*a* by lengths D11 and D31 shorter than the lengths D12 and D33 of the protruding portions protruding in a direction in which the coupling pattern is spaced apart from the patch antenna pattern 110*a*.

Inwardly protruding portions of the coupling patterns 130*a* may be intensely coupled to the patch antenna pattern 110*a*. Accordingly, the coupling patterns 130*a* may have a more dispersed structure from the intensely coupled portion. Thus, a gain of the patch antenna pattern 110*a* may improve.

A spacing distance $aper_w$ between the inwardly protruding portions of the plurality of coupling patterns 130*a* may be appropriately designed in accordance with a length of a side $dir_w$ of the coupling patch pattern 115*a*.

Figure 1E:
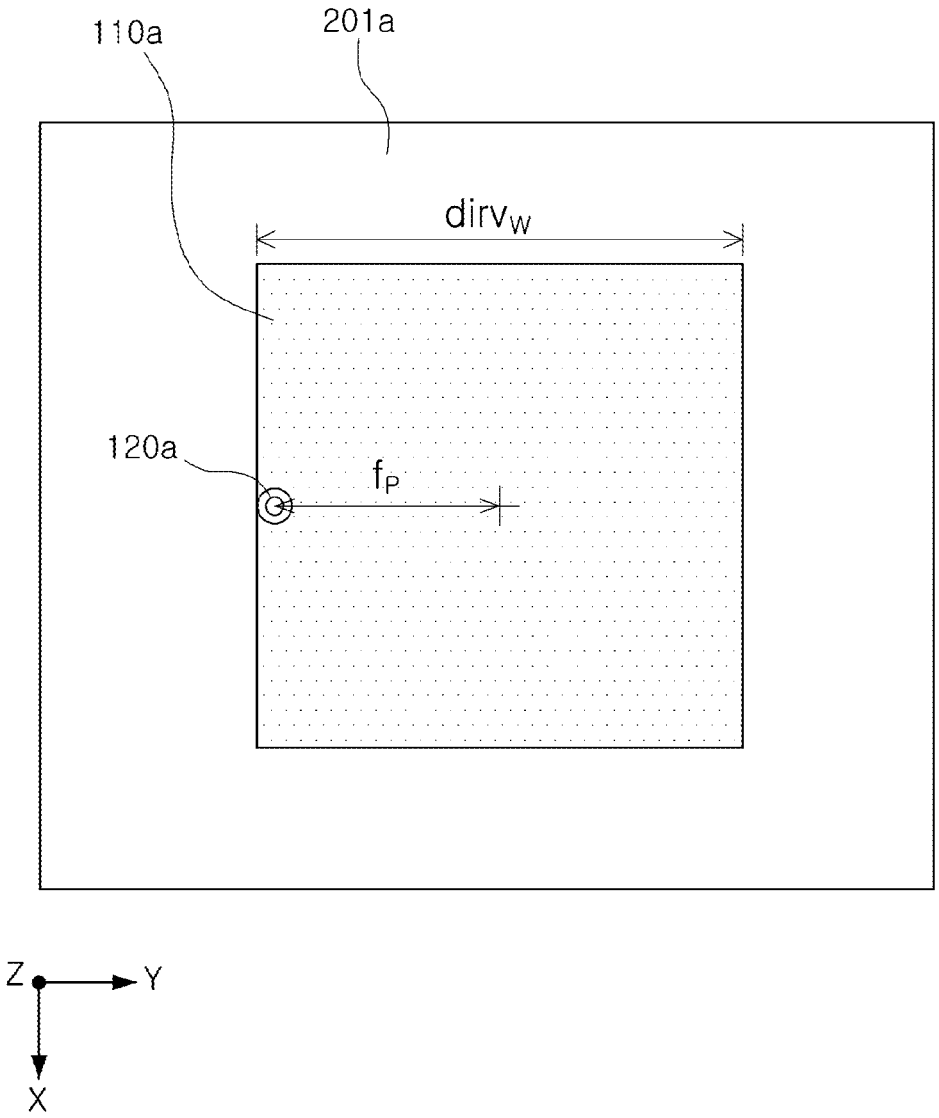
FIG. 1E is a plan view illustrating a patch antenna pattern and a feed via of the antenna apparatus of FIG. 1A, according to an embodiment.

FIG. 1E is a plan view illustrating the patch antenna pattern 110*a* and the feed via 120*a* of the antenna apparatus 100, according to an embodiment.

Referring to FIG. 1E, a length of a side $dirv_w$, of the patch antenna pattern 110*a* may be shorter than a length of a side of the ground plane 201*a*.

A region overlapping the coupling patterns 130*a* on a second layer on which the patch antenna pattern 110*a* is disposed may be formed of a non-conductive medium (e.g., air or a dielectric material). Accordingly, a conductive structure may not be connected between the coupling patterns 130*a* and the ground plane 201*a*.

Accordingly, the coupling patterns 130*a* may greatly affect a gain and/or a bandwidth of the patch antenna pattern 110*a*.

FIGS. 2A to 2E are plan views illustrating a process of designing coupling patterns of an antenna apparatus, according to an embodiment.

Figure 2A:
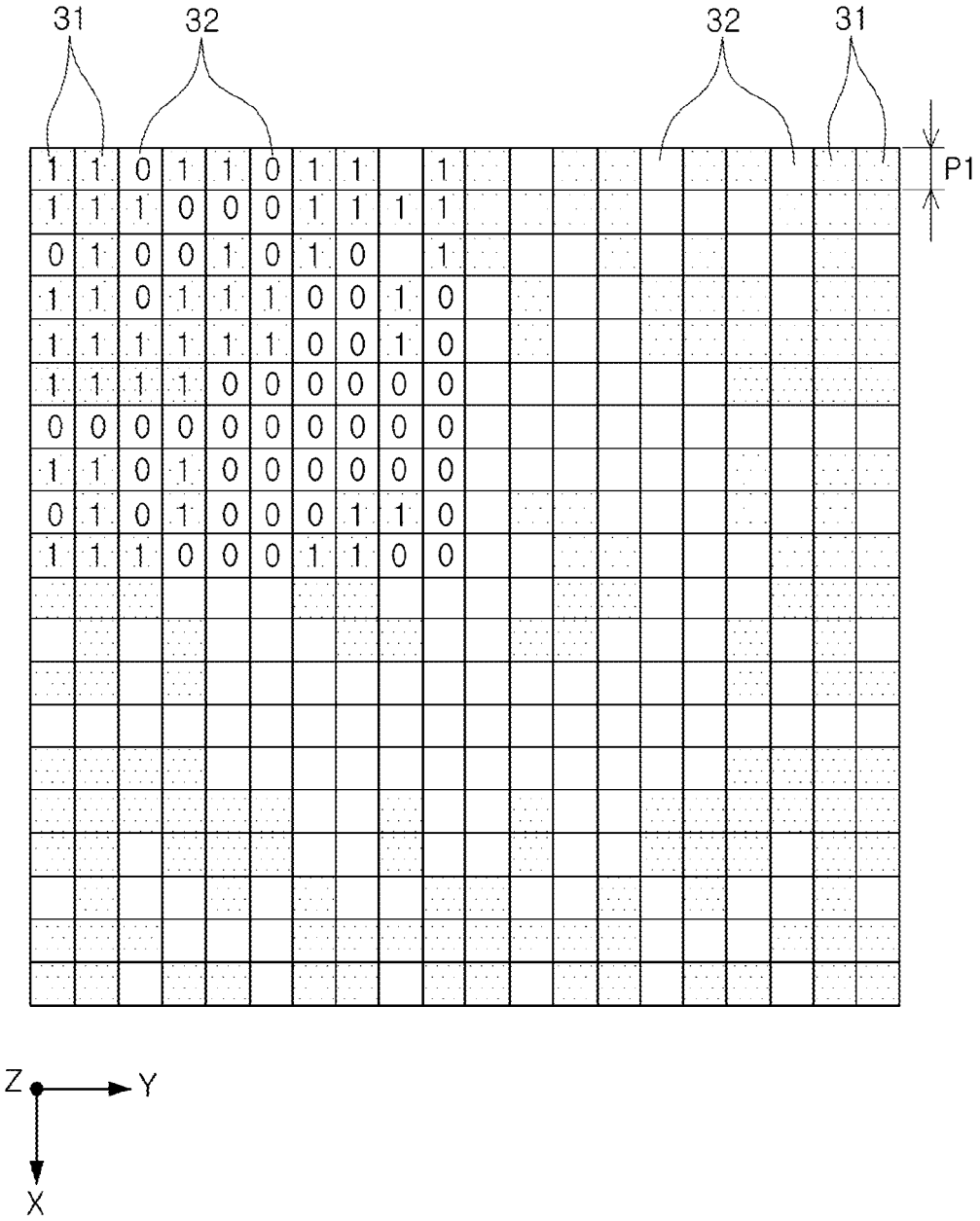
FIGS. 2A to 2E are plan views illustrating a process of designing coupling patterns of an antenna apparatus, according to an embodiment.

Referring to FIG. 2A, a first layer may include pixels 31 and 32 arranged in an M×N structure, where M and N are natural numbers. The pixels 31 and 32 may include an occupied pixel 31 occupied by coupling patterns and a non-occupied pixel 32 which is not occupied by the coupling patterns. Whether the pixels 31 and 32 are occupied may be determined based on an electromagnetics analysis and/or a numerical method. A length P1 of a side of each of the pixels 31 and 32 may be determined based on M and N.

For example, whether the pixels 31 and 32 are occupied may be determined by repeating a process of comparing electromagnetic properties (e.g., a gain, a bandwidth, and the like) of when one of the pixels 31 and 32 is occupied with electromagnetic properties of when none of the plurality of pixels 31 and 32 are occupied and selecting a state of electromagnetic properties closer to target electromagnetic properties.

Each of the coupling patterns may occupy the pixels by unit of the pixels 31 and 32 each having a size (e.g., an area) smaller than a size (e.g., an area) of the smallest coupling pattern among the coupling patterns, and may have five or more vertices. Accordingly, each of the coupling patterns may have a polygonal shape having more vertices than vertices of a rectangular form of each of the plurality of pixels 31 and 32.

Accordingly, the coupling patterns may have an electromagnetically efficient structure.

Figure 2B:
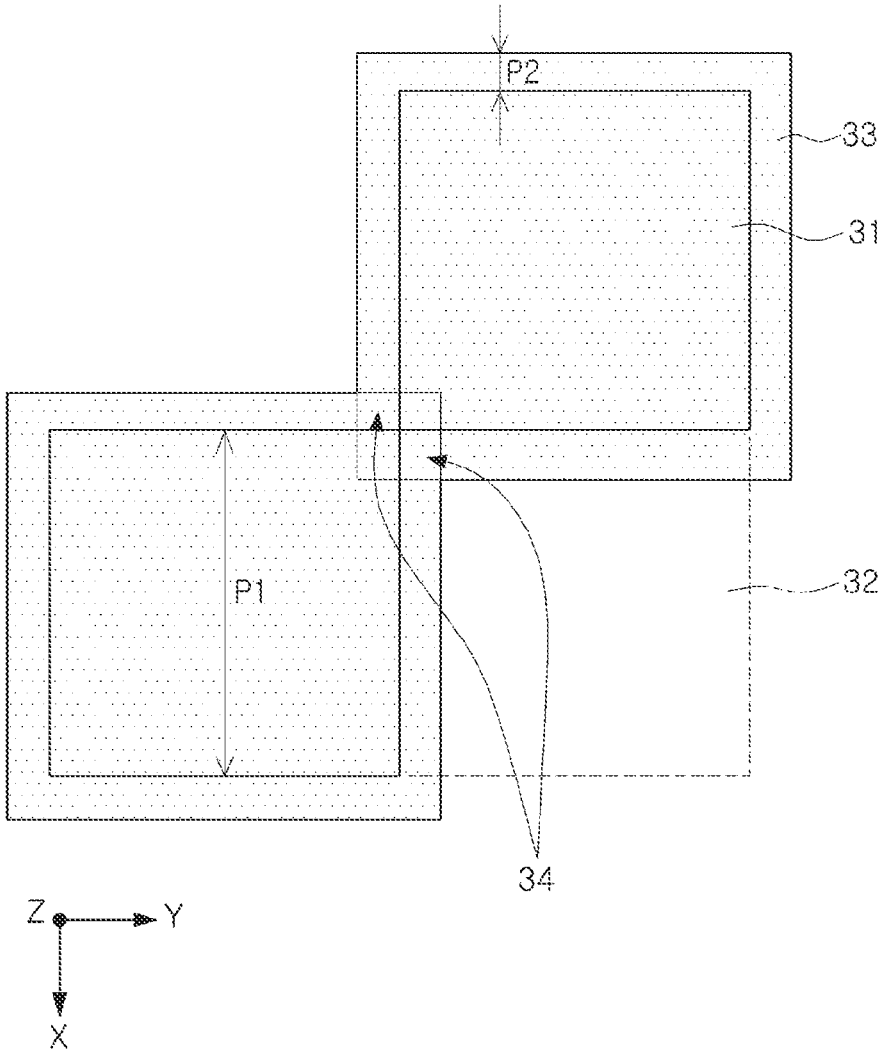

Referring to FIG. 2B, a size of the occupied pixel 31 may increase by a second length P2, and the occupied pixel 31 may become an expanded pixel 33. Accordingly, a connection region 34 may be formed between the occupied pixels 31.

A width of each of the expanded pixels 33 corresponding to the occupied pixels 31 may be greater than a width of each of the non-occupied pixels 32. Accordingly, the occupied pixels 31 may be reliably connected to each other.

As the expanded pixel 33 is occupied by a final coupling pattern, in the final coupling pattern, the occupied pixel may have a size (e.g., an area) greater than a size (e.g., an area) of the non-occupied pixel.

Figure 2C:
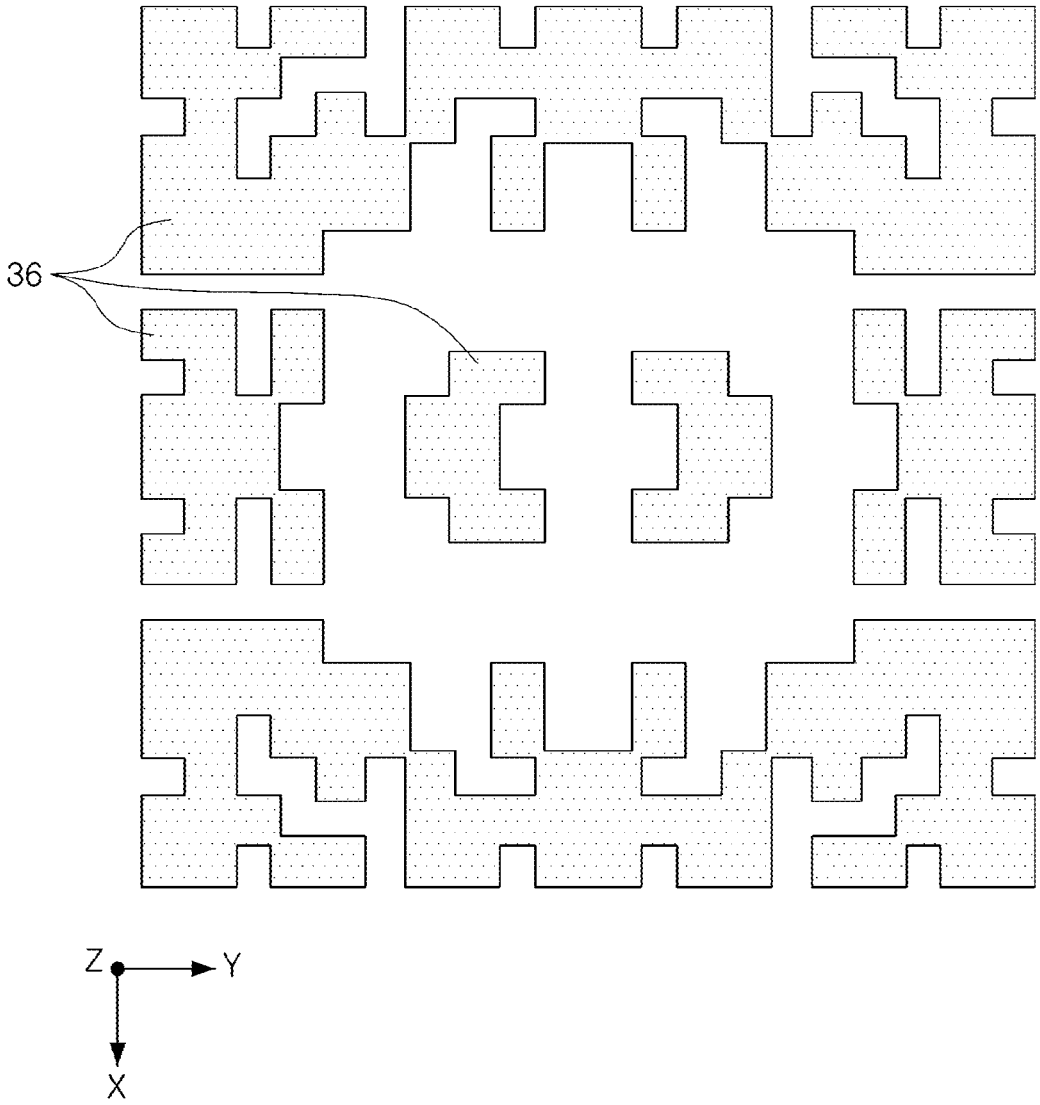

Referring to FIG. 2C, a coupling pre-pattern 36 may occupy a first layer by unit of a plurality of pixels.

Figure 2D:
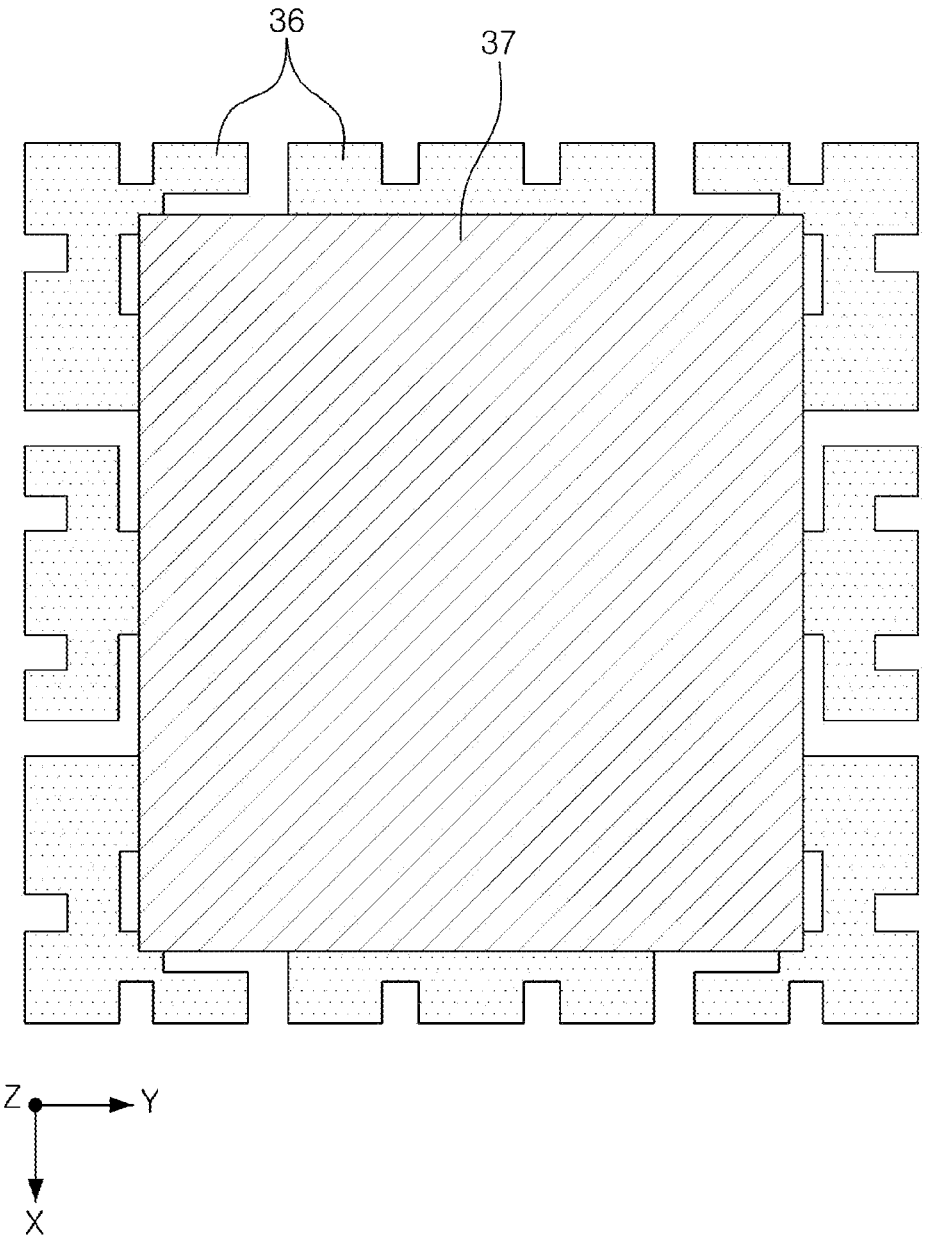

Referring to FIG. 2D, a coupling patch pattern region 37 of the coupling pre-pattern 36 may be removed. Accordingly, a region in which all of final coupling patterns are arranged may surround the coupling patch pattern region 37.

Figure 2E:
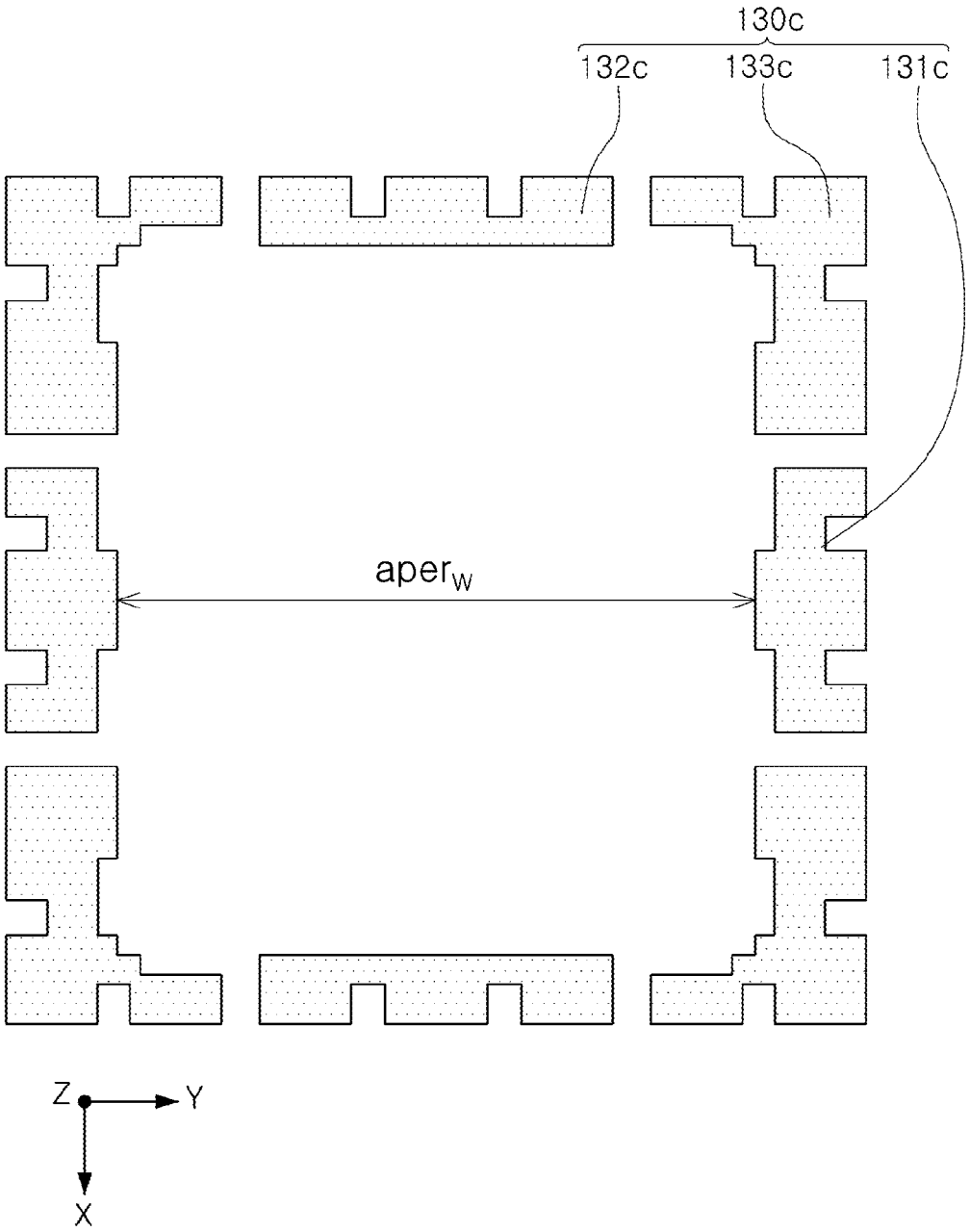

Referring to FIG. 2E, coupling patterns 130*c* may include a first-direction coupling pattern 132*c*, a second-direction coupling pattern 131*c*, and a corner coupling pattern 133*c*.

Figure 3A:
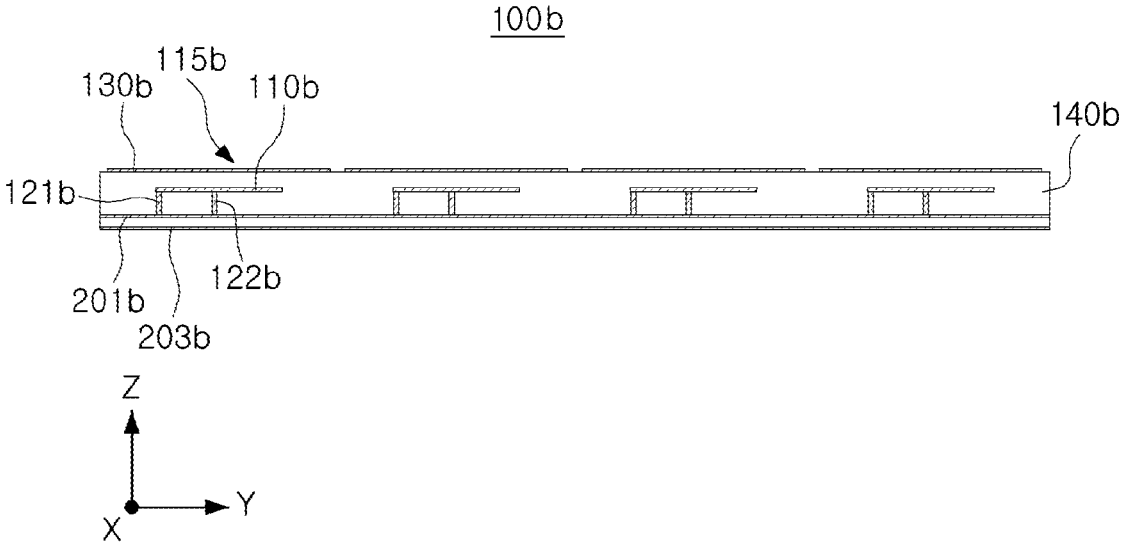
FIG. 3A is a side view illustrating an arrangement structure of an antenna apparatus, according to an embodiment.

FIG. 3A is a side view illustrating an arrangement structure of an antenna apparatus 100*b*, according to an embodiment.

Referring to FIG. 3A, in the antenna apparatus 100*b*, patch antenna patterns 110*b* and coupling patch patterns 115*b* may be arranged in a row in the second direction (e.g., the Y direction).

A dielectric layer 140*b* may fill regions around the patch antenna patterns 110*b*.

Each of the patch antenna patterns 110*b* may be electrically connected to first and second feed vias 121*b* and 122*b*. The first and second feed vias 121*b* and 122*b* may extend towards a first ground plane 201*b*.

A third ground plane 203*b* may be disposed on a level lower (e.g., in the Z direction) than a level of the first ground plane 201*b*.

Figure 3B:
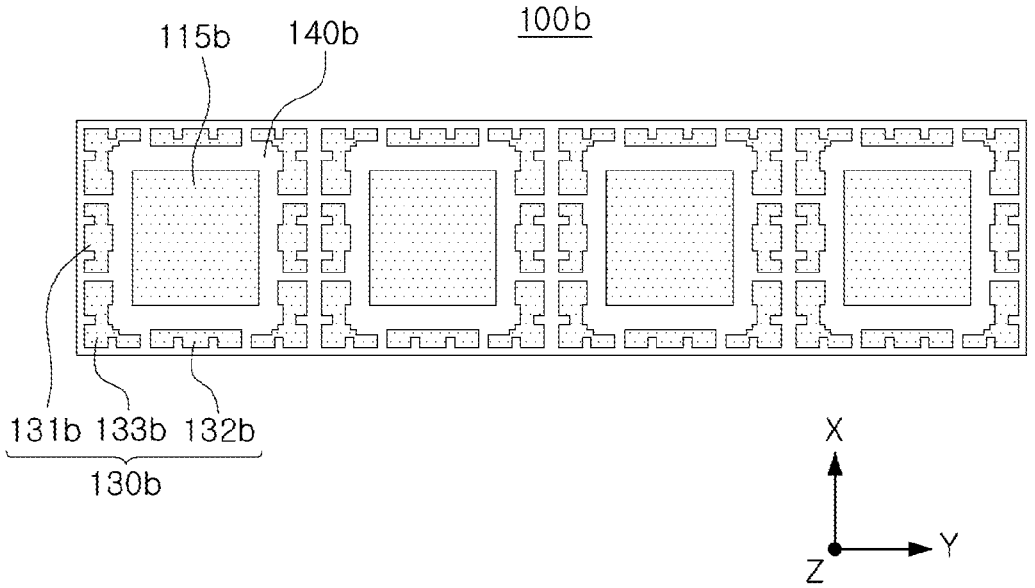
FIG. 3B is a plan view illustrating the arrangement structure of the antenna apparatus of FIG. 3A, according to an embodiment.

FIG. 3B is a plan view illustrating the arrangement structure of the antenna apparatus 100*b*, according to an example embodiment.

Referring to FIG. 3B, coupling patterns 130*b* may be arranged to surround the coupling patch patterns 115*b*, respectively.

Each of the coupling patterns 130*b* may include a first-direction coupling pattern 132*b*, a second-direction coupling pattern 131*b*, and a corner coupling pattern 133*b*.

A size (e.g., an area) of the first-direction coupling pattern 132*b* may be smaller than a size (e.g., an area) of the second-direction coupling pattern 131*b*.

Accordingly, the coupling patterns 130*b* may significantly decrease electromagnetic interference working in a second direction, and accordingly, electromagnetic interference between the patch antenna patterns 110*b* arranged in a row in the second direction may effectively decrease.

The second-direction coupling pattern 131*b* may be configured to protrude towards a patch antenna pattern 110*b*, and the first-direction coupling pattern 132*b* may be configured to not protrude towards the patch antenna pattern 110*b*.

Accordingly, the coupling patterns 130*b* may significantly decrease electromagnetic interference working in a second direction, and accordingly, electromagnetic interference between the patch antenna patterns 110*b* arranged in the second direction may effectively decrease.

Figure 3C:
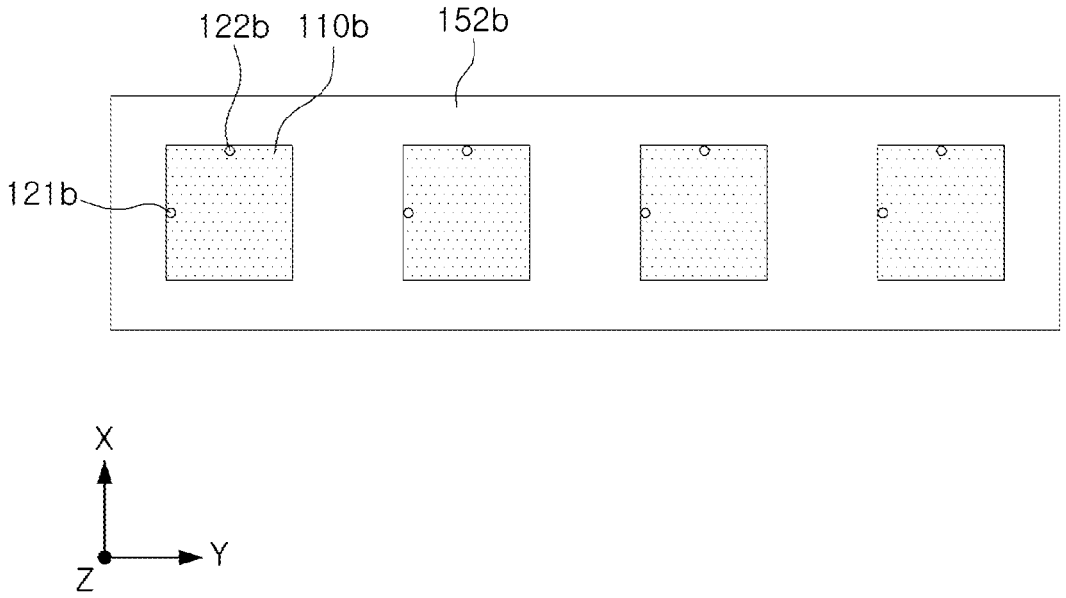
FIG. 3C is a plan view illustrating an arrangement structure of a patch antenna pattern of the antenna apparatus of FIG. 3A, according to an example embodiment of the present disclosure.

FIG. 3C is a plan view illustrating an arrangement structure of the patch antenna pattern 110*b* of the antenna apparatus 100*b*, according to an embodiment.

Referring to FIG. 3C, a core region 152*b* may be disposed on a lower side of each of the patch antenna patterns 110*b*. First and second feed vias 121*b* and 122*b* may be disposed adjacent to one side in second and first directions from a center of each of the patch antenna patterns 110*b*.

Accordingly, the patch antenna patterns 110*b* may remotely transmit and receive a horizontal polarization (H pol.) RF signal and a vertical polarization (V pol.) RF signal, which are in a polarization relationship with each other, together.

A region disposed on the same level (e.g., in the Z direction) as a level of the patch antenna patterns 110*b* and overlapping coupling patch patterns 115*b* may be formed of a non-conductive medium. Accordingly, the coupling patch patterns 115*b* may relay electromagnetic couplings between the patch antenna patterns 110*b* and the coupling patterns 130*b*, respectively, and may thus provide various levels of impedance to the patch antenna patterns 110*b*. Accordingly, a bandwidth of each of the patch antenna patterns 110*b* may be widened.

Also, because a via connecting the coupling patterns 130*b* to a ground plane is not disposed in the overlapping region, the coupling patterns 130*b* may further widen a bandwidth of each of the patch antenna patterns 110*b*.

Figure 3D:
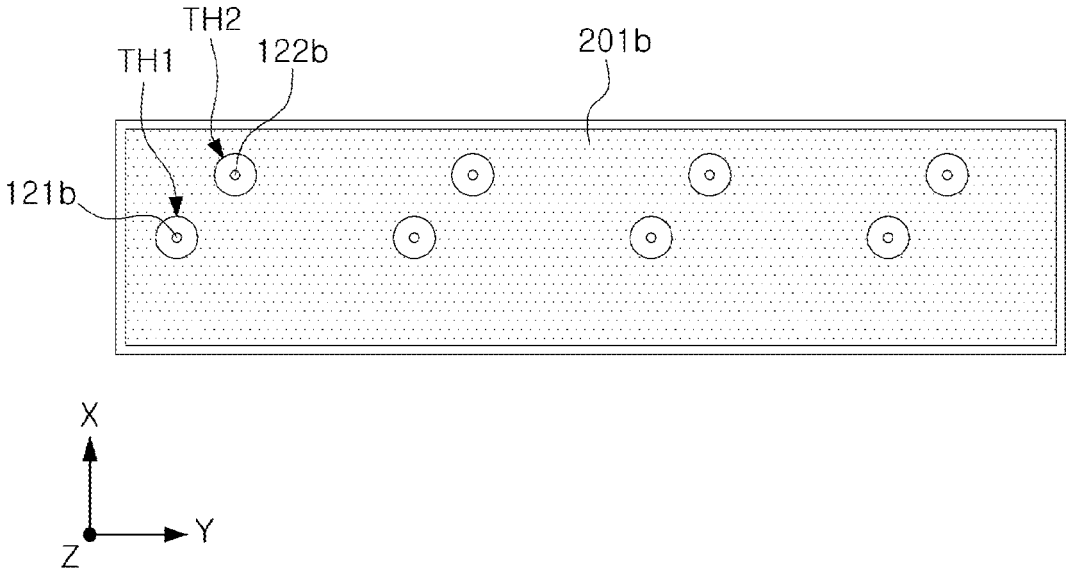
FIG. 3D is a plan view illustrating a first ground plane of the antenna apparatus of FIG. 3A, according to an embodiment.

FIG. 3D is a plan view illustrating a first ground plane 201*b* of the antenna apparatus 100*b*, according to an embodiment.

Referring to FIG. 3D, the first ground plane 201*b* may have first and second through-holes TH1 and TH2 through which the first and second feed vias 121*b* and 122*b* penetrate, respectively.

Figure 3E:
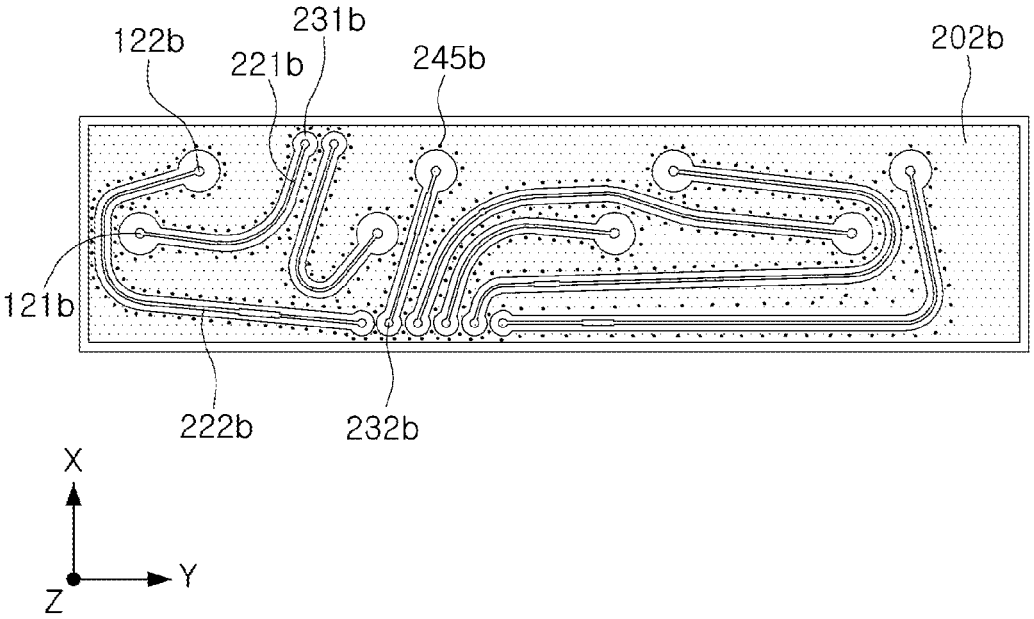
FIG. 3E is a plan view illustrating feed lines of the antenna apparatus of FIG. 3A, according to an embodiment.

FIG. 3E is a plan view illustrating feed lines 221*b* and 222*b* of the antenna apparatus 100*b*, according to an embodiment.

Referring to FIG. 3E, a second ground plane 202*b* may surround the first and second feed lines 221*b* and 222*b*.

The first and second feed lines 221*b* and 222*b* may electrically connect the first and second feed vias 121*b* and 122*b* to wiring vias 231*b* and 232*b*, respectively.

Shielding vias 245*b* may be electrically connected to a second ground plane 202*b*, and may be arranged to surround the first and second feed lines 221*b* and 222*b*, respectively.

Figure 3F:
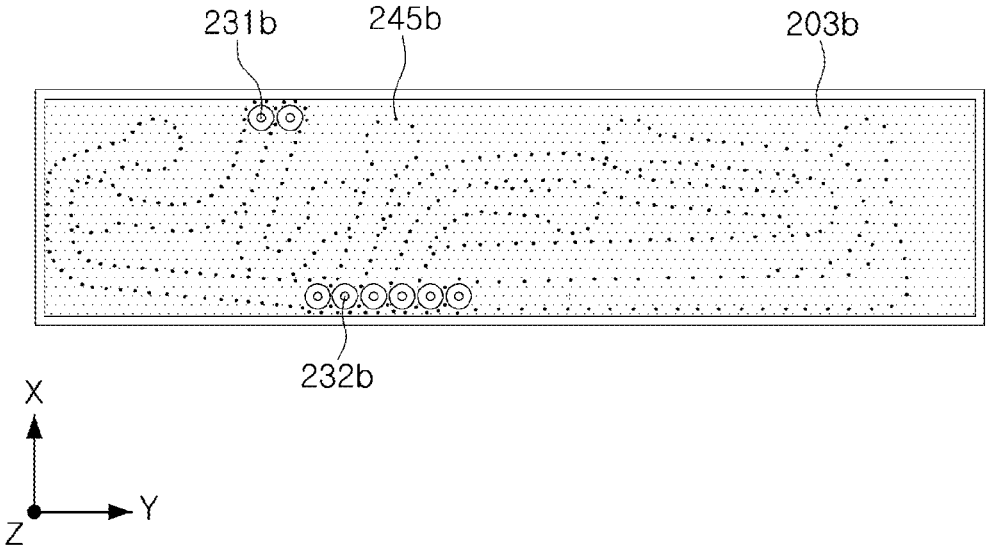
FIG. 3F is a plan view illustrating wiring vias of the antenna apparatus of FIG. 3A, according to an example.

FIG. 3F is a plan view illustrating wiring vias 231*b* and 232*b* of the antenna apparatus 100*b*, according to an embodiment.

Referring to FIG. 3F, a third ground plane 203*b* may have through-holes through which the wiring vias 231*b* and 232*b* penetrate.

The wiring vias 231*b* and 232*b* may be electrically connected to an IC disposed on a lower side of the third ground plane 203*b*.

Figure 4A:
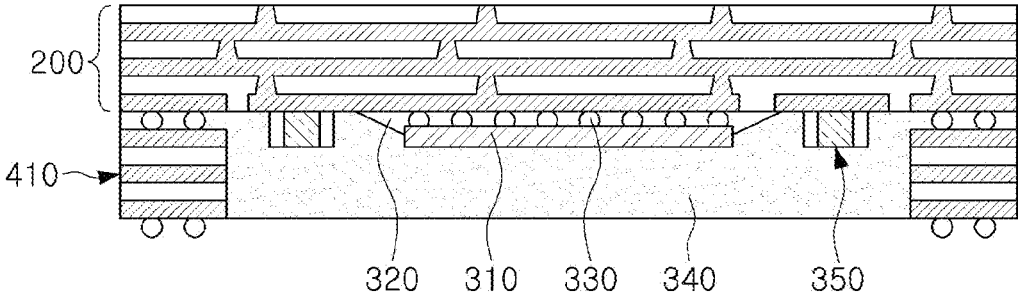
FIGS. 4A and 4B are views illustrating a connection member included in the antenna apparatuses illustrated in FIGS. 1A to 3F, in which ground planes are layered, and a lower structure of the connection member, according to an embodiment.
Figure 4B:
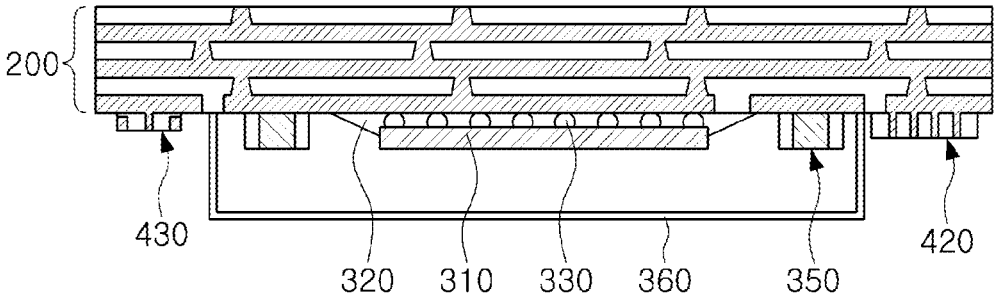

FIGS. 4A and 4B are views illustrating a connection member 200 included in the antenna apparatuses illustrated in FIGS. 1A to 3F, in which ground planes are layered, and a lower structure of the connection member 200, according to embodiments.

Referring to FIG. 4A, an antenna apparatus may include at least portions of a connection member 200, an IC 310, an adhesive member 320, an electrical interconnect structure 330, an encapsulant 340, a passive component 350, and a sub-substrate 410.

The connection member 200 may have a structure in which the above-described ground planes are laminated.

The IC 310 may be the same as the above-described IC, and may be disposed on a lower side of the connection member 200. The IC 310 may be electrically connected to a wiring line of the connection member 200, and may transmit or receive an RF signal. The IC 310 may also be electrically connected to a ground plane of the connection member 200 and may be provided with a ground. For example, the IC 310 may generate a converted signal by performing at least portions of frequency conversion, amplification, filtering, a phase control, and power generation.

The adhesive member 320 may allow the IC 310 and the connection member 200 to be adhered to each other.

The electrical interconnect structure 330 may electrically connect the IC 310 and the connection member 200 to each other. For example, the electrical interconnect structure 330 may have a structure such as a solder ball, a pin, a land, a pad, or the like. The electrical interconnect structure 330 may have a melting point lower than melting points of a wiring line and a ground plane of the connection member 200, and may electrically connect the IC 310 and the connection member 200 to each other through a process using the low melting point.

The encapsulant 340 may encapsulate at least a portion of the IC 310, and may improve a heat dissipation performance and a protection performance against impacts. For example, the encapsulant 340 may be implemented by a photoimageable encapsulant (PIE), an Ajinomoto build-up film (ABF), an epoxy molding compound (EMC), or the like.

The passive component 350 may be disposed on a lower surface of the connection member 200, and may be electrically connected to a wiring line and/or a ground plane of the connection member 200 through the interconnect structure 330.

The sub-substrate 410 may be disposed on a lower surface of the connection member 200, and may be electrically connected to the connection member 200 to receive an intermediate frequency (IF) signal or a baseband signal from an external entity and to transmit the signal to the IC 310, or to receive an IF signal or a baseband signal from the IC 310 and to transmit the signal to an external entity. A frequency (e.g., 24 GHz, 28 GHz, 36 GHz, 39 GHz, 60 GHz) of the RF signal may be greater than a frequency (e.g., 2 GHz, 5 GHz, 10 GHz, and the like) of the IF signal.

For example, the sub-substrate 410 may transmit an IF signal or a baseband signal to the IC 310, or may receive the signal from the IC 310 through a wiring line included in an IC ground plane of the connection member 200. As a first ground plane of the connection member 200 is disposed between the IC ground plane and a wiring line, an IF signal or a baseband signal and an RF signal may be electrically isolated from each other in an antenna module.

Referring to FIG. 4B, an antenna apparatus may include at least portions of a shielding member 360, a connector 420, and a chip antenna 430.

The shielding member 360 may be disposed on a lower side of the connection member 200 and may enclose the IC 310 along with the connection member 200. For example, the shielding member 360 may cover or conformally shield the IC 310 and the passive component 350 together, or may separately cover or compartmentally shield the IC 310 and the passive component 350. For example, the shielding member 360 may have a hexahedral shape in which one surface is open, and may have an accommodating space having a hexahedral form by being combined with the connection member 200. The shielding member 360 may be implemented by a material having relatively high conductivity such as copper, such that the shielding member 360 may have a skin depth, and the shielding member 360 may be electrically connected to a ground plane of the connection member 200. Accordingly, the shielding member 360 may reduce electromagnetic noise that the IC 310 and the passive component 350 receive.

The connector 420 may have a connection structure of a cable (e.g., a coaxial cable or a flexible PCB), may be electrically connected to the IC ground plane of the connection member 200, and may work similarly to the above-described sub-substrate. Accordingly, the connector 420 may be provided with an IF signal, a baseband signal, and/or power from a cable, or may provide an IF signal and/or a baseband signal to a cable.

The chip antenna 430 may transmit or receive an RF signal in addition to the antenna apparatus. For example, the chip antenna 430 may include a dielectric block having a dielectric constant higher than that of an insulating layer, and electrodes disposed on opposing surfaces of the dielectric block. One of the electrodes may be electrically connected to a wiring line of the connection member 200, and another one of the electrodes may be electrically connected to a ground plane of the connection member 200.

Figure 5A:
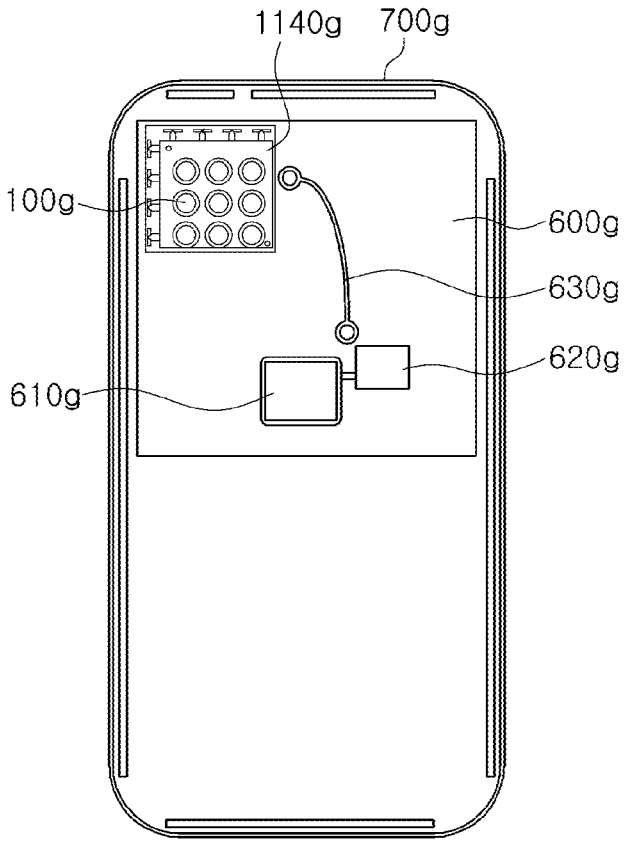
FIGS. 5A and 5B are plan views illustrating examples of electronic devices in which antenna apparatuses are disposed, according to embodiments.
Figure 5B:
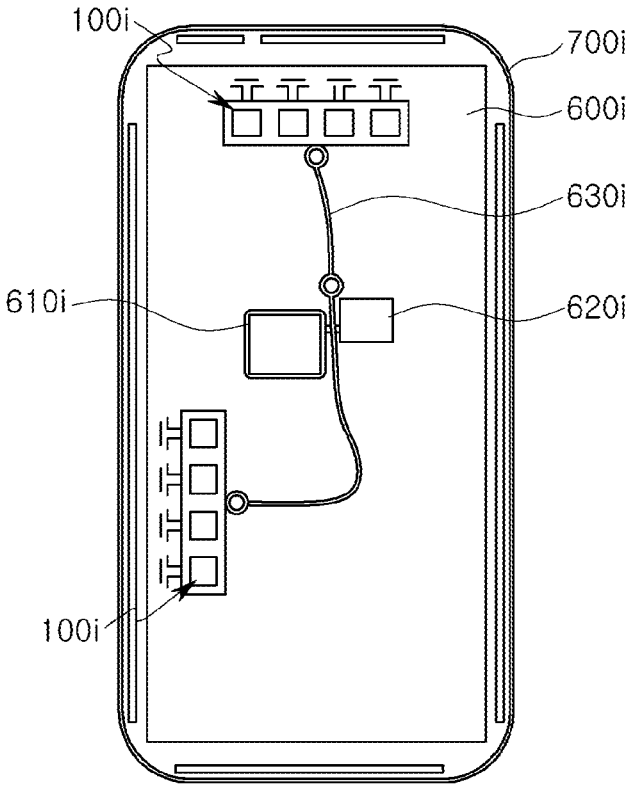

FIGS. 5A and 5B are plan views illustrating examples of electronic devices 700*g* and 700*i*, respectively, in which an antenna apparatuses 100*g* and 100*i* are respectively disposed.

Referring to FIG. 5A, an antenna module including the antenna apparatus 100*g* may be disposed adjacent to a side surface boundary of the electronic device 700*g* on a set substrate 600*g* of the electronic device 700*g*. The antenna apparatus 100*g* may include a connection member 1140*g*.

The electronic device 700*g* may be a smartphone, a personal digital assistant, a digital video camera, a digital still camera, a network system, a computer, a monitor, a tablet PC, a laptop PC, a netbook PC, a television, a video game system, a smart watch, an Automotive component, or the like, but the electronic device 700*g* is not limited to the foregoing examples.

A communication module 610*g* and a baseband circuit 620*g* may be disposed on the set substrate 600*g*. The antenna module may be electrically connected to the communication module 610*g* and/or the baseband circuit 620*g* through a coaxial cable 630*g*.

The communication module 610*g* may include at least portions of a memory chip such as a volatile memory (e.g., a DRAM), a non-volatile memory (e.g., a ROM), a flash memory, or the like; an application processor chip such as a central processor (e.g., a CPU), a graphics processor (e.g., a GPU), a digital signal processor, a cryptographic processor, a microprocessor, a microcontroller, or the like; and a logic chip such as an analog-to-digital converter, an application-specific integrated circuit (ASIC), or the like.

The baseband circuit 620*g* may generate a base signal by performing analog-to-digital conversion, and amplification, filtering, and frequency conversion on an analog signal. A base signal input to and output from the baseband circuit 620*g* may be transferred to the antenna module through a cable.

For example, the base signal may be transferred to an IC through an electrical interconnect structure, a cover via, and a wiring line. The IC may convert the base signal into an RF signal of mmWave band.

Referring to FIG. 5B, antenna modules each including an antenna apparatus 100*i* may be disposed adjacent to centers of sides of the electronic device 700*i* having a polygonal shape on a set substrate 600*i* of the electronic device 700*i*, and a communication module 610*i* and a baseband circuit 620*i* may be disposed on the set substrate 600*i*. The antenna apparatus 100*i* and the antenna module may be electrically connected to the communication module 610*i* and/or the baseband circuit 620*i* through a coaxial cable 630*i*.

The patch antenna pattern, the coupling patch pattern, the coupling pattern, the feed via, the feed line, the ground plane, the shielding via, the wiring via, and the an electrical interconnect structure described in the example embodiments may include a metal material (e.g., a conductive material such as copper (Cu), aluminum (Al), silver (Ag), tin (Sn), gold (Au), nickel (Ni), lead (Pb), titanium (Ti), or alloys thereof), and may be formed by a plating method such as a chemical vapor deposition (CVD) method, a physical vapor deposition (PVD) method, a sputtering method, a subtractive method, an additive method, a semi-additive process (SAP), a modified semi-additive process (MSAP), or the like, but the material and the formation method of the aforementioned components are not limited to the examples provided herein.

The dielectric layer and/or the insulating layer described in the embodiments herein may be implemented by a material such as FR4, a liquid crystal polymer (LCP), low temperature co-fired ceramic (LTCC), a thermosetting resin such as an epoxy resin, a thermoplastic resin such as a polyimide resin, a resin in which the above-described resin is impregnated in a core material, such as a glass fiber (or a glass cloth or a glass fabric), together with an inorganic filler, prepreg, a Ajinomoto build-up film (ABF), FR-4, bismaleimide triazine (BT), a photoimageable dielectric (PID) resin, a general copper clad laminate (CCL), glass or a ceramic-based insulating material, or the like.

The RF signal described in the example embodiments may include protocols such as wireless fidelity (Wi-Fi) (Institute of Electrical And Electronics Engineers (IEEE) 802.11 family, or the like), worldwide interoperability for microwave access (WiMAX) (IEEE 802.16 family, or the like), IEEE 802.20, long term evolution (LTE), evolution data only (Ev-DO), high speed packet access+(HSPA+), high speed downlink packet access+(HSDPA+), high speed uplink packet access+(HSUPA+), enhanced data GSM environment (EDGE), global system for mobile communications (GSM), global positioning system (GPS), general packet radio service (GPRS), code division multiple access (CDMA), time division multiple access (TDMA), digital enhanced cordless telecommunications (DECT), Bluetooth, 3G, 4G, and 5G protocols, and any other wireless and wired protocols designated after the above-mentioned protocols, but the RF signal is not limited to the examples provided herein.

According to the embodiments described herein, an antenna apparatus may have improved antenna performances (e.g., a gain, a bandwidth, directivity, and the like) and/or may have a reduced size.

The communication modules 610*g* and 610*i* in FIGS. 5A and 5B that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a feed via;

a patch antenna pattern electrically connected to the feed via; and coupling patterns spaced apart from the patch antenna pattern and spaced apart from each other, wherein a first coupling pattern, among the coupling patterns, is spaced apart from the patch antenna pattern in a first direction and comprises one or more first protruding portions protruding in the first direction.

2. The antenna apparatus of claim 1, wherein the one or more first protruding portions protruding protrude at different locations.

3. The antenna apparatus of claim 2, wherein a width of a gap between adjacent protruding portions among the one or more first protruding portions is less than a width of each of the one or more first protruding portions.

4. The antenna apparatus of claim 1, wherein a second coupling pattern, among the coupling patterns, is spaced apart from the patch antenna pattern in a second direction different from the first direction and comprises one or more second protruding portions protruding in the second direction, and wherein the second coupling pattern has an area greater than an area of the first coupling pattern.

5. The antenna apparatus of claim 4, wherein the patch antenna pattern comprises patch antenna patterns, and wherein the patch antenna patterns are arranged in a row in the second direction.

6. The antenna apparatus of claim 1, wherein a second coupling pattern, among the coupling patterns, is spaced apart from the patch antenna pattern in a second direction different from the first direction and comprises second protruding portions, wherein one of the second protruding portions protrudes in the second direction, and another one of the second protruding portions protrudes towards the patch antenna pattern, and wherein the other one of the second protruding portion protrudes towards the patch antenna portion by a length shorter than a length by which the one of the second protruding portions protrudes in the second direction.

7. The antenna apparatus of claim 1, wherein a second coupling pattern, among the coupling patterns, is spaced apart from the patch antenna pattern in a second direction different from the first direction and comprises one or more second protruding portions protruding in the second direction and one or more other second protruding portions protruding towards the patch antenna pattern, and wherein the first coupling pattern does not comprise a portion protruding towards the patch antenna pattern.

8. The antenna apparatus of claim 1, further comprising:

a ground plane having a through-hole through which the feed via penetrates, wherein a conductive structure is not connected between the coupling patterns and the ground plane.

9. The antenna apparatus of claim 1, further comprising:

a coupling patch pattern disposed above the patch antenna pattern and spaced apart from the patch antenna pattern, wherein the coupling patterns are arranged to surround the coupling patch pattern.

10. The antenna apparatus of claim 1, wherein, in a region including pixels, each of the coupling patterns occupies the pixels by unit of the pixels, each pixel has an area smaller than an area of a smallest coupling pattern among the coupling patterns, and each of the coupling patterns is disposed to occupy portions of the pixels and to not occupy other portions of the pixels.

11. The antenna apparatus of claim 1, wherein a second coupling pattern, among the coupling patterns, is spaced apart from the patch antenna pattern in a second direction different from the first direction and comprises one or more second protruding portions protruding in the second direction, and wherein a corner coupling pattern, among the coupling patterns, is disposed between the first coupling pattern and the second coupling pattern.

12. The antenna apparatus of claim 11, wherein the one or more first protruding portions comprise three or more first protruding portions, the one or more second protruding portions comprise three or more second protruding portions, and the corner pattern comprises three or more third protruding portions protruding in directions in which the corner pattern is spaced apart from the patch antenna pattern.

13. An antenna apparatus, comprising:

a feed via;

a patch antenna pattern electrically connected to the feed via; and coupling patterns spaced apart from the patch antenna pattern and spaced apart from each other, wherein, in a region including pixels, each pixel has an area smaller than an area of a smallest coupling pattern among the coupling patterns, and each of the coupling patterns occupies some pixels, among the pixels, and comprises five or more vertices.

14. The antenna apparatus of claim 13, wherein a width of the some pixels occupied by the coupling patterns is greater than a width of other pixels, among the pixels, that are not occupied by the coupling patterns.

15. The antenna apparatus of claim 13, further comprising:

a coupling patch pattern disposed above the patch antenna pattern and spaced apart from the patch antenna pattern, wherein the coupling patch pattern and the coupling patterns are disposed on a same level.

16. The antenna apparatus of claim 15, wherein a region disposed on a level of the patch antenna pattern and overlapping the coupling patch pattern is formed of a non-conductive medium.

17. The antenna apparatus of claim 13, wherein the patch antenna pattern comprises patch antenna patterns, and wherein the patch antenna patterns are arranged in a row in one direction.

18. The antenna apparatus of claim 17, wherein a coupling pattern, among the coupling patterns, spaced apart from the patch antenna patterns in the one direction has an area greater than an area of a coupling pattern, among the coupling patterns, spaced apart from the patch antenna patterns in another direction different from the one direction.

* * * * *